US005286224A

United States Patent [19]

Paulus

[11] Patent Number: 5,286,224

[45] Date of Patent: Feb. 15, 1994

[54] INTERCHANGEABLE CONTACT CONNECTOR

[75] Inventor: Eric J. Paulus, Scottsdale, Ariz.

[73] Assignee: ITT Corporation, Secaucus, N.J.

[21] Appl. No.: 59,223

[22] Filed: May 10, 1993

[51] Int. Cl.[5] ..... H01R 13/66

[52] U.S. Cl. ..... 439/620; 333/185

[58] Field of Search ..... 439/620, 608; 333/181-185

[56] References Cited

U.S. PATENT DOCUMENTS

| | | | |
|---|---|---|---|
| 3,447,104 | 5/1969 | Schor | 333/79 |
| 3,710,285 | 1/1973 | Schor et al. | 333/79 |
| 3,743,979 | 7/1973 | Schor | 333/79 |
| 3,790,858 | 2/1974 | Brancaleone et al. | 317/99 |
| 4,275,945 | 6/1981 | Krantz et al. | 439/620 |
| 4,431,251 | 2/1984 | Krantz | 439/608 |
| 4,494,092 | 1/1985 | Griffin | 333/182 |
| 4,741,710 | 5/1988 | Hogan et al. | 439/620 |
| 4,747,789 | 5/1988 | Gliha | 439/620 |
| 4,768,977 | 9/1988 | Gliha, Jr. et al. | 439/620 |
| 4,820,174 | 4/1989 | Farrar et al. | 439/95 |
| 4,846,732 | 7/1989 | Meelhuysen | 439/620 |
| 4,954,794 | 9/1990 | Nieman et al. | 333/182 |
| 5,032,809 | 7/1991 | Chambers et al. | 333/183 |
| 5,164,873 | 11/1992 | Krantz et al. | 439/620 |
| 5,198,958 | 3/1993 | Krantz, Jr. | 439/608 |

*Primary Examiner*—Gary F. Paumen
*Attorney, Agent, or Firm*—Thomas L. Peterson

[57] ABSTRACT

A connector is provided of the type which has replaceable contact assemblies, including a contact assembly (14, FIG. 3) with a circuit component (70) thereon that has three terminals (72, 74, 76), one (72) connected to the body (54) of the contact assembly, a second (74) connected to a first clip (80) which engages a ground plane (50) of the connector, and a third terminal (76) which engages a second clip (82). A circuit board (52) is mounted in the connector in a plane normal to the axes (31) of the contact assemblies, the circuit board having holes (110) that each receive a different contact assembly. A hole that receives the component contact assembly, is plated and holds a spring clip device (120) that has fingers (124) that bear against the second clip.

14 Claims, 5 Drawing Sheets

FIG. 7
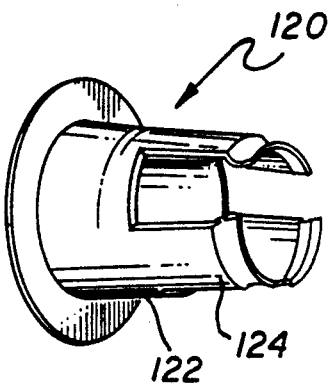
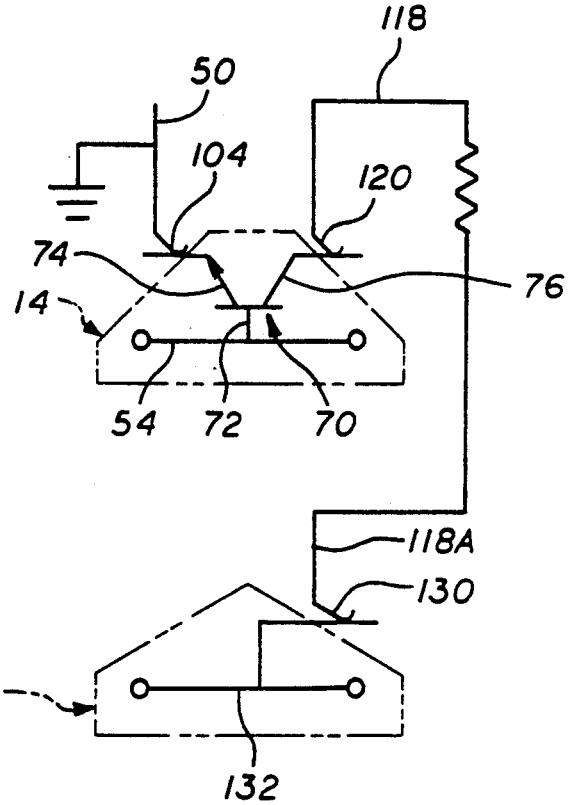
FIG. 8
FIG. 9
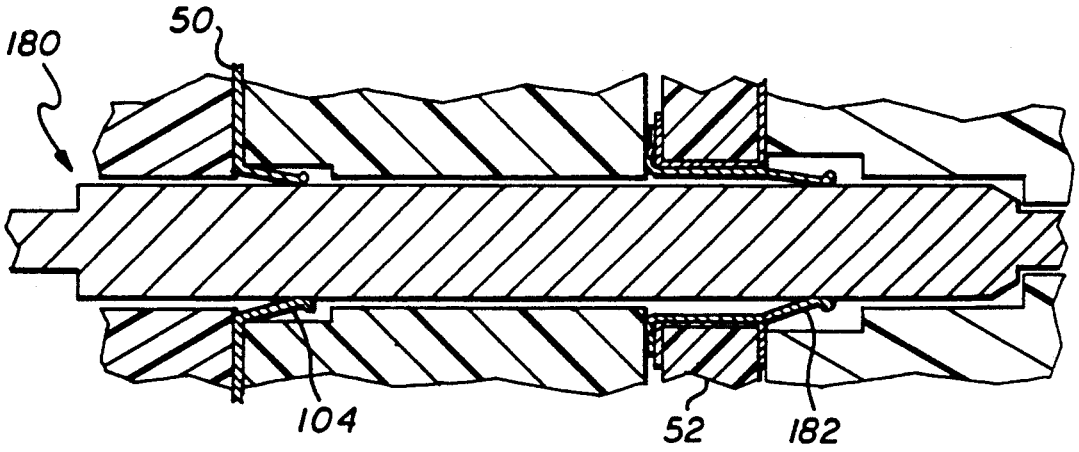

INTERCHANGEABLE CONTACT CONNECTOR

BACKGROUND OF THE INVENTION

One type of connector includes contact assemblies with diodes and/or filter components. Such contact assemblies divert to ground any high voltage pulses, and can filter out frequency signals of unwanted frequencies. If a diode is destroyed when diverting a high energy pulse to ground, the contact assembly can be removed and another installed by sliding it until a clip on the contact assembly wipes against a ground plane mounted in the insulator assembly. The replaceable contact assemblies connect to circuitry which may include circuit boards holding multi-terminal components such as transistors and integrated circuits. Due to the easy replaceability of contact assemblies, it would be desirable if components more complex than diodes could be readily replaced.

SUMMARY OF THE INVENTION

In accordance with one embodiment of the present invention, a connector is provided with replaceable contact assemblies, wherein at least one contact assembly includes a three terminal circuit component. The three-terminal circuit component is mounted on the middle of the body of the contact assembly, with the first terminal of the component connected to the body. Second and third terminals of the component are connected respectively to first and second clips that each have an exposed periphery. As in the prior art, the exposed periphery of the first clip engages a ground plane of the connector. In the present invention, the connector is provided with a circuit board lying in a plane perpendicular to the axis of the contact assembly. A hole in the circuit board that receives the component contact assembly, holds a spring clip device with fingers that wipe against the exposed periphery of the second clip as the contact assembly is installed. The spring clip device is connected to a trace on the circuit board. The circuit board trace can be connected to a signal contact assembly of the connector.

The novel features of the invention are set forth with particularity in the appended claims. The invention will be best understood from the following description when read in conjunction with the accompanying drawings.

BRIEF DESCRIPTION OF THE DRAWINGS

FIG. 7 is an isometric view of a spring clip device of the connector of FIG. 6.

FIG. 8 is a simplified schematic diagram of part of the circuitry of the connector of FIG. 6.

FIG. 9 is a partial sectional view of a double grounding contact assembly constructed in accordance with the present invention.

DESCRIPTION OF THE PREFERRED EMBODIMENTS

Figure 6:
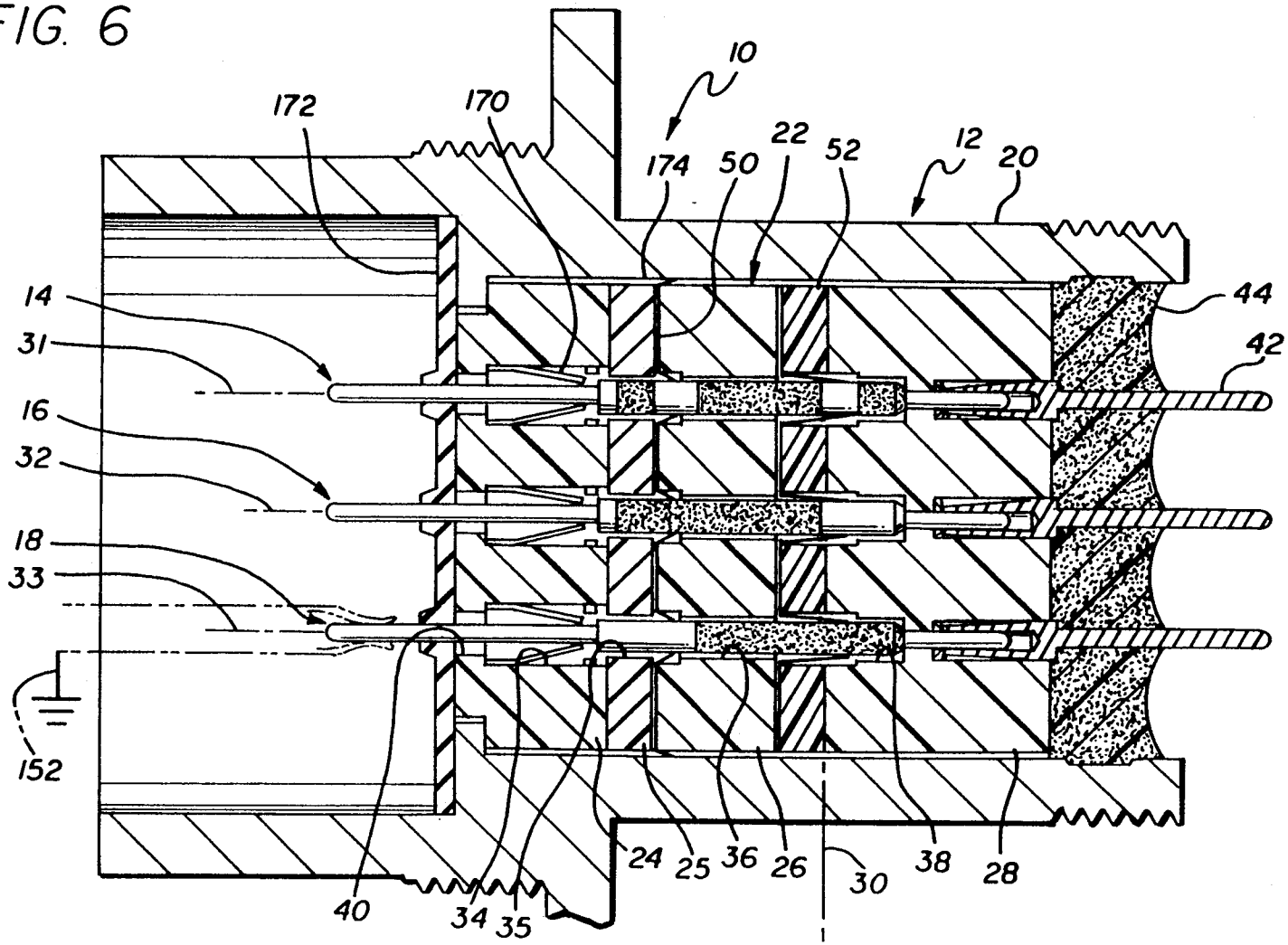
FIG. 6 is a sectional view taken on the line 6—6 of FIG. 1.

FIG. 6 illustrates a connector 10 of the present invention, which includes a housing 12 and a plurality of contact assemblies 14–18 installed therein. The housing includes a metal shell 20 and an insulator assembly 22 within the shell. The insulator assembly includes four plate-like insulators 24, 25, 26 and 28 with their faces lying in planes such as 30 that extend normal to the axes 31–33 of the contact assemblies. It is noted that the axis 32 of one of the contact assemblies is coincident with the axis of the connector and of its shell.

Each of the insulators 24–28 has a plurality of holes such as 34, 35, 36 and 38 with the holes being aligned and forming passages 40 that each receives one of the contact assemblies. It is noted that the particular connector shown includes a plurality of tail contacts 42 that are each fixed in place in a quantity 44 of potting materials such as epoxy, and that each have forward ends engaged with the rearward end of a corresponding contact assembly. The connector also includes a ground plane 50 of conductive material such as a copper alloy, for grounding some of the contact assemblies. The connector also includes a circuit board 52 with surfaces lying parallel to plane 30, whose function will be described below.

Figure 1:
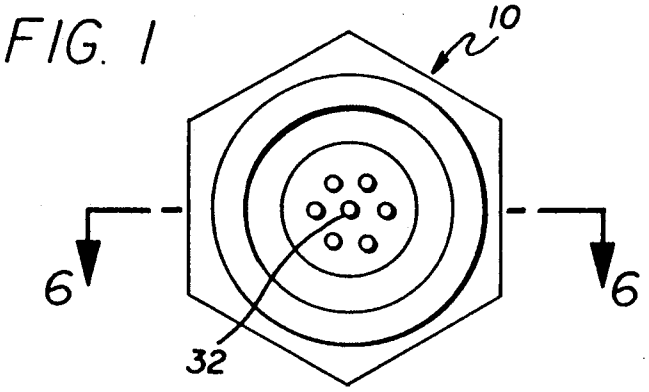
FIG. 1 is a front elevation view of a connector constructed in accordance with one embodiment of the present invention.
Figure 2:
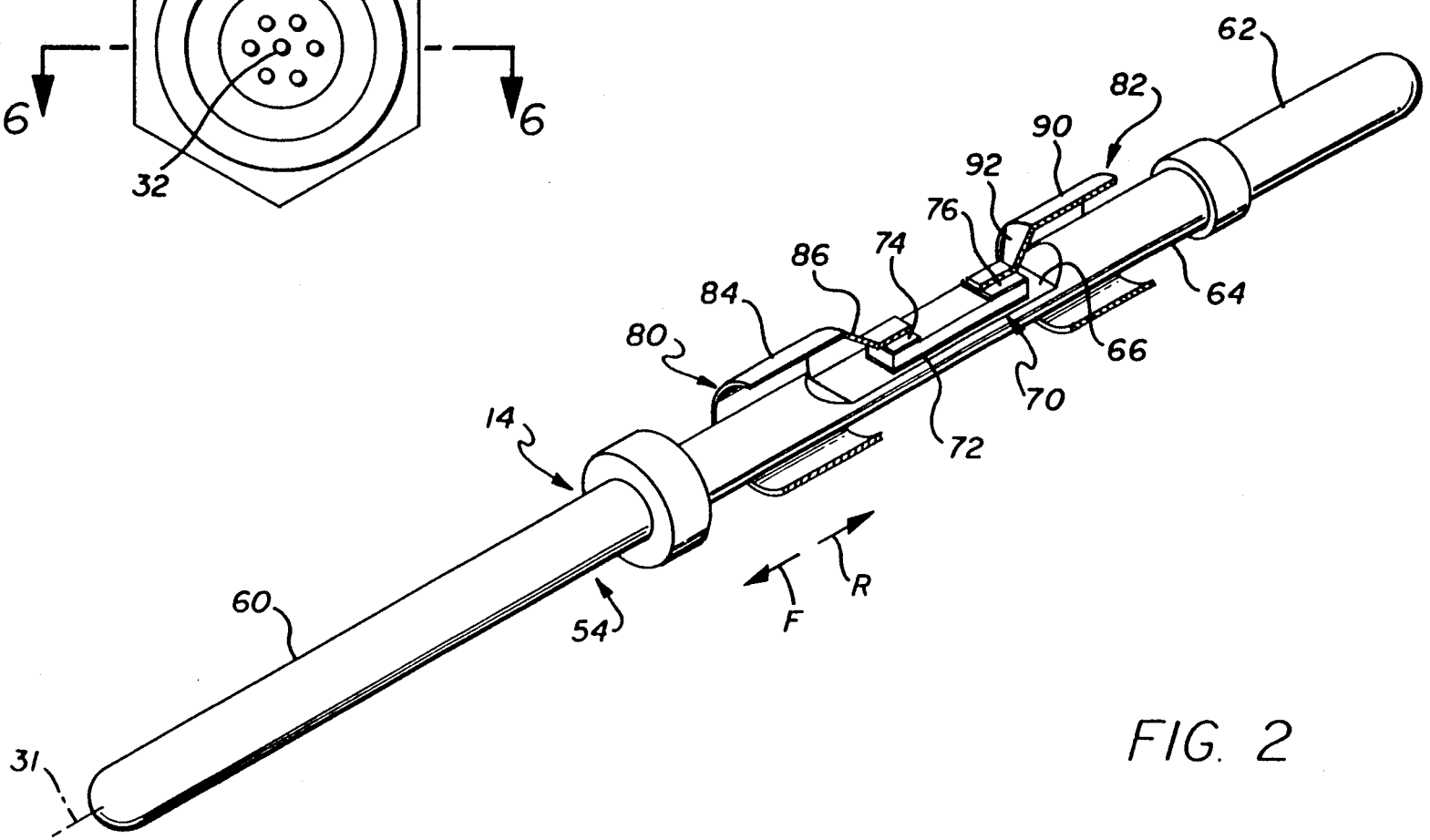
FIG. 2 is an isometric view of a three component contact assembly of the connector of FIG. 1, with the clips shown in section.

FIG. 2 shows details of the first contact assembly 14. It includes a conductive body 54 that has forward and rearward end portions 60, 62 and a middle 64 between them. The middle forms a platform 66 which holds a three terminal circuit component 70. The component can be a transistor, voltage regulator, or other device. The circuit component has a first terminal 72 which contacts the middle 64 of the contact body, and has second and third terminals 74, 76. Connection is made to the second and third terminals by first and second clips 80, 82. The first clip has a band part 84 lying forwardly, in direction F, of most of the component 70. The first clip also has a finger 86 extending largely rearwardly from the band part, in direction R, and also radially inwardly towards the contact axis 31, with the finger connected to the component second terminal 74 as by soldering. The second clip 82 is similarly constructed, but its band part 90 lies rearwardly of most of the circuit component 70. The finger 92 of the second clip extends forwardly and with a radially inward directional component from the band and connects to the third terminal 76 of the circuit component. For clarity, FIG. 2 shows the clips 80, 82 in section, but does not show potting material which protects the circuit component and stabilizes the positions of the clips.

Figure 3:
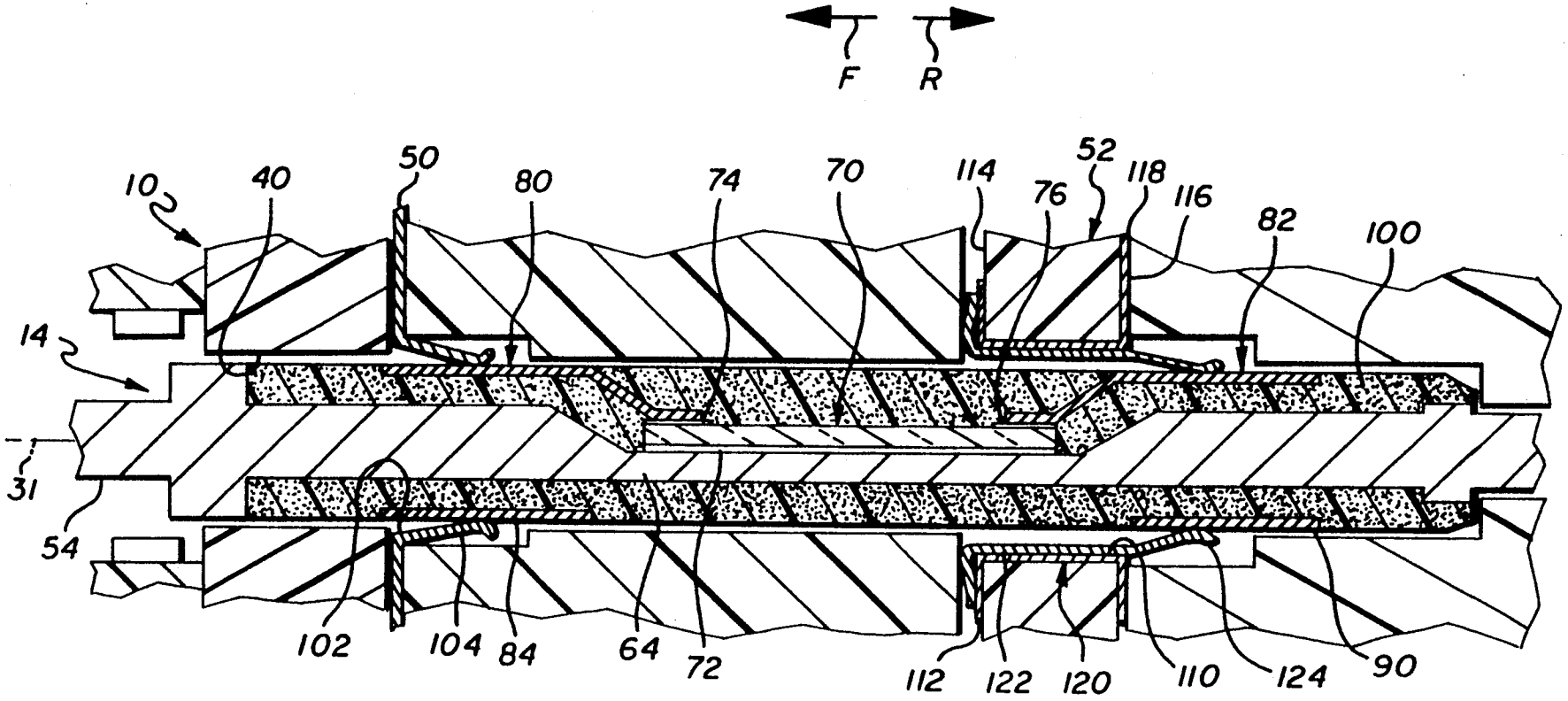
FIG. 3 is a partial sectional view of the three terminal contact assembly of FIG. 2, showing it fully installed in the connector of FIG. 1.

FIG. 3 shows the middle of the component contact assembly 14, fully installed in the connector 10. This figure shows a quantity 100 of dielectric material which isolates the clip band parts from the contact body 54. The dielectric material 100 is a potting material which surrounds the three-terminal circuit component 70 and which lies within the band parts 84, 90 of the clips 80, 82. The ground plane 50 has a hole 102 and has tines 104 at the hole that engage the band part 84 of the first clip, to thereby ground the second terminal 74 of the circuit component.

The circuit board 52 has a plated-through hole 110, with the plating including a portion 112 that lies on a forward surface 114 of the board as well as on the opposite rearward surface 116, with the rearward part of the plating merging with a conductive trace 118. The circuit board includes a spring clip device 120 that connects the plating part 112 and trace 118, to the second clip 82, and therefore to the third terminal 76 of the circuit component. The spring clip device has a largely cylindrical part 122 that is fastened to the circuit board plating as by soldering thereto. A plurality of fingers 124 extends rearwardly from the cylindrical part and slightly towards the contact axis 31, to engage the band part 90 of the second clip. Thus, when the component contact assembly 14 is installed, by moving it rearwardly into the passage 40, the band parts 84, 90 of its first and second clips make electrical connection respectively with the ground plane 50 and circuit board trace 118. The contact assembly can be removed in a forward direction F, and its clip band parts then move slidably out of contact with the ground plane tines and circuit board clip device fingers.

FIG. 8 is a simplified schematic diagram showing the interconnection of the contact assemblies. The component contact assembly is represented at 14, with the conductive body 54 shown connected to the first terminal 72 of the three terminal circuit component 70. The finger 104 of the ground plane 50 connects the second terminal 74 to ground. The spring clip device 120 connects the third terminal 76 to the circuit board trace 118. The trace 118 connects, either directly or through a small circuit component (e.g. resistor, capacitor, diode) to another circuit board trace portion 118A. The second trace portion 118A connects to a second spring clip device 130 that connects to the conductive body 132 of the bias/signal contact 16. Thus, the signal on the body 54 of the component contact assembly 14 is modified by the circuit component 70, and the modified signal is delivered (with possible additional modification) carries the modified signal to circuitry outside the connector.

Figure 4:
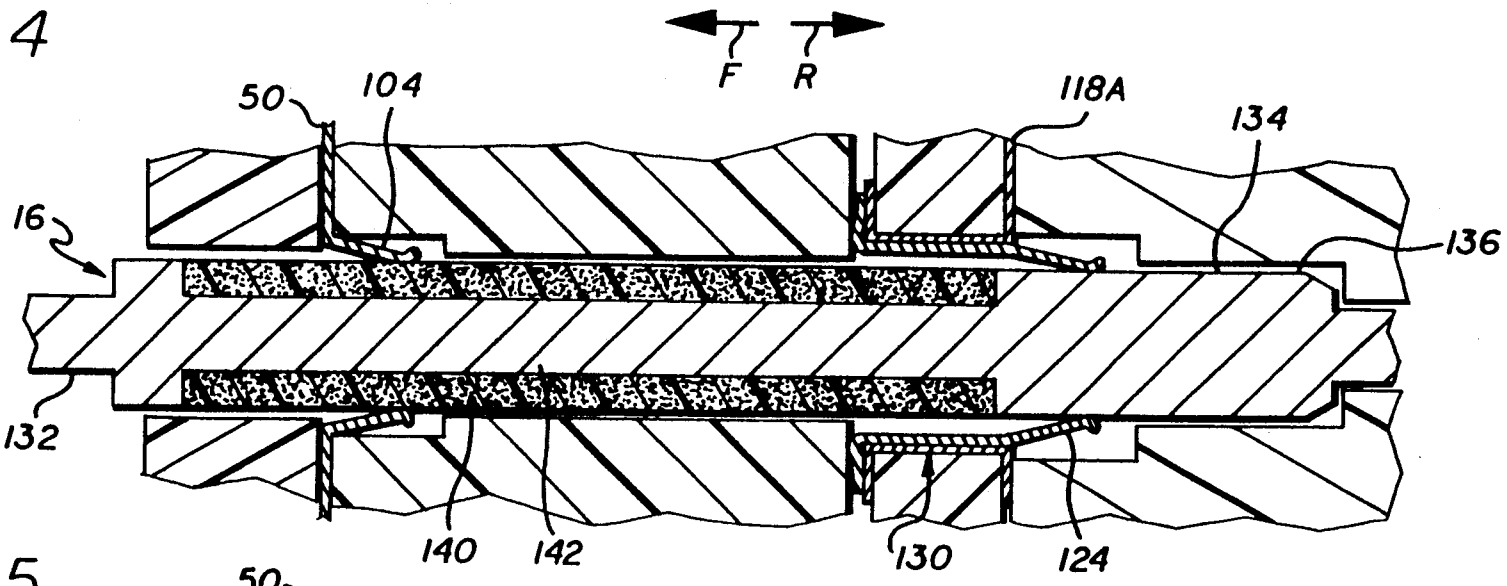
FIG. 4 is a partial sectional view of a signal/bias contact assembly, showing it fully installed in the connector.

FIG. 4 shows mechanical details of the bias/signal contact assembly 16. This contact assembly includes a conductive body 132 with a board-connected part 134 having a substantially cylindrical outer surface 136. The second spring clip device 130 is of the same construction as the earlier described first one 120. The fingers 124 of the second clip device engage the cylindrical surface 136 of the conductive body 132. In this way, the bias/signal contact assembly 16 is electrically coupled to the third terminal 76 of the three terminal circuit device on the component contact assembly 14.

Applicant must prevent the body 132 of the bias/signal contact assembly from engaging the tines 104 of the ground plane 50. This is accomplished by a quantity 140 of potting material that lies around a reduced-diameter, or narrowed, part 142 of the conductive body 132. The outside diameter of the plotting material 140 is of substantially the same outside diameter as the band part of the first clip 80 on the component contact assembly 14. This facilitates insertion of any of the contact assemblies into any of the passages without difficulty. It also enables the ground plane fingers to stabilize the position of every contact assembly. Such interchangeability enables the customer who buys the connector and selected contact assemblies, to be assured that any contact assembly can be installed in any of the passages. It may be noted that the bias/signal contact can be used to transmit a constant voltage (bias), as well as a signal that rapidly changes in voltage. However, the bias/signal contact assembly is usually used to transmit a signal, and then can be referred to as a signal contact assembly.

Figure 5:
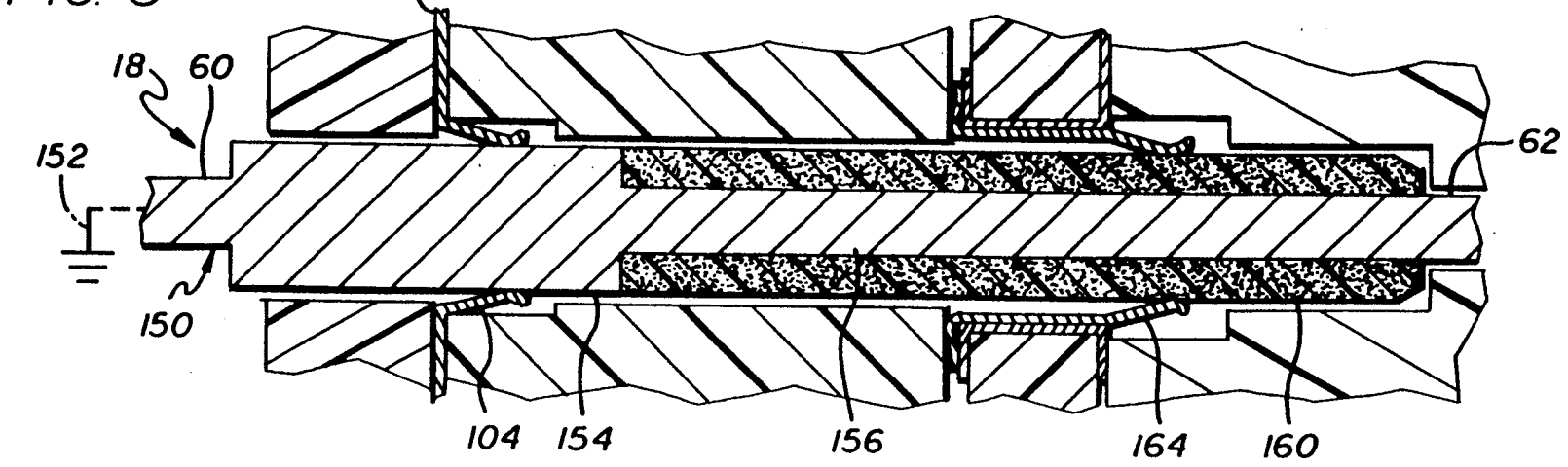
FIG. 5 is a partial sectional view showing a ground contact assembly fully installed in the connector.

FIG. 5 illustrates the third contact assembly 18 which is a ground contact assembly. The ground contact assembly 18 has a conductive body 150 that is connected to ground at either its front or rear portion 60, 62. The purpose of the ground contact assembly 18 is to maintain the ground plane 50 at ground potential, as by connection indicated at 152 to ground. The ground body 150 has a cylindrical outer surface at 154 adjacent to the ground plane 50 to contact the tines 104 of the ground plane lying at the corresponding hole therein. The body 150 has a reduced diameter portion at 156 which is surrounded by a third quantity 160 of potting material such as epoxy, to provide the same outside diameter as the middle of the other contact assemblies. Thus a third spring contact device 164 does not electrically connect to the ground contact assembly.

Referring again to FIG. 6, it can be seen that the connector includes a retainer 170 in each hole 34 of the insulator 24, to retain the corresponding contact. A front release tool can be inserted through a soft rubber seal 172 to expand the fingers of the retainer and allow the corresponding contact assembly to be pulled out. During such pullout, the contact assembly slides across the tines of the ground plane 50 and the fingers of the spring clip devices that are mounted on the circuit board.

It should be noted that it is possible for the ground plane 50 to be grounded by providing fingers, indicated in phantom lines at 174, at its periphery that bear against the inside wall of the shell 20. However, this may require plating of the inside surface of the shell 20 to assure good contact of the ground plane therewith. It is also possible to provide a double grounding contact assembly 180 shown in FIG. 9, instead of the grounding contact assembly 18 shown in FIG. 5. The contact assembly 180 in FIG. 9 is intended to contact the ground plane 50, and also a spring clip assembly 182 which is connected to a ground plane of the circuit board 52.

Thus, the invention provides a component contact assembly that can hold a circuit component with three terminals, and which provides means for connection to each of the terminals. The component contact assembly includes first and second clips that are respectively connected to the second and third terminals of the component, with each clip having a largely cylindrical exposed band, with a first band connected to a ground plane of the connector. The connector includes a circuit board whose surfaces extend in a plane normal to the axes of the contact assemblies. The circuit board carries a spring clip device in each of its holes, the clip device having fingers that engage the band of the second clip on the component contact assembly. The circuit board has traces that can connect to a bias/signal contact assembly to thereby connect the third terminal of the component on the component contact assembly, to circuitry outside the connector.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector having a housing with an insulator assembly forming a plurality of passages, having a ground plane mounted on said insulator assembly, and having a plurality of contact assemblies each mounted in one of said passages, including a first contact assembly that includes a conductive body having forward and rearward ends and a middle, and that includes a circuit component that is mounted on said contact middle and that has a plurality of terminals including a first terminal connected to said body middle and a second terminal, and that includes a first clip connected to said second terminal and electrically coupled to said ground plane, characterized by:

said circuit component has a third terminal; and including a second clip electrically coupled to said third terminal;

a circuit board mounted in said housing and having a first conductive trace electrically coupled to said second clip.

2. The connector described in claim 1 wherein:

said circuit board has a plurality of holes each aligned with a corresponding one of said passages, including a first hole, said first trace plating at least a region on said board which surrounds said first hole;

a spring device which lies in said first hole of said circuit board and which is electrically connected to said first trace, said spring device having a plurality of spring fingers which press against said second clip, to thereby electrically couple said component third terminal to said first circuit board trace.

3. The connector described in claim 1 wherein:

said plurality of contact assemblies includes a bias/signal contact assembly lying in a second of said passages, said bias/signal contact assembly having an electrically conductive body which includes a board-connected part having a substantially cylindrical outer surface and lying adjacent to a second of said holes in said circuit board, and said circuit board having a second trace coupled to said first trace and connected to said cylindrical outer surface.

4. The connector described in claim 3 wherein:

said body of said bias/signal contact assembly has a narrowed part adjacent to said ground plane, and including a quantity of insulative potting material lying about said narrowed part and forming a substantially cylindrical outer surface.

5. The connector described in claim 1 wherein:

said plurality of contact assemblies includes a ground contact assembly lying in a third of said passages, said ground contact assembly having an electrically conductive body connected to said ground plane;

means for maintaining a ground potential on said body of said ground contact assembly independently of said ground plane, to thereby electrically ground said ground plane by means of said ground contact assembly.

6. Connection apparatus, comprising:

an elongated conductive body having forward and rearward ends and a middle, for reception in a passage of a connector insulator assembly;

a circuit component mounted on said contact body middle, said component having a first terminal connected to said body middle, and said component having second and third terminals;

a first clip having a band part lying forward of a portion of said component and having a finger extending partially rearwardly from said band part and connected to said component second terminal;

a second clip having a band part lying rearward of a portion of said component and having a finger extending largely forwardly from said second clip band part and connected to said component third terminal;

a quantity of dielectric material which lies within said band portions of said first and second clips and isolates said band portions from said contact body.

7. The connection apparatus described in claim 6 including:

a connector having a shell and an insulator assembly mounted in said shell, said insulator assembly having a plurality of passages, and said body with said component, clips and dielectric material lying in a first of said passages;

a ground plane lying within said shell and having a plurality of holes each aligned with one of said passages, said clips including a ground and a board clip and said ground plane coupled to said ground clip;

a circuit board mounted in said shell and having a plurality of holes including a first hole aligned with said first passage in said insulator assembly, said circuit board having a plurality of conductive traces, including a first trace electrically coupled to said board clip.

8. The connection assembly described in claim 7, including:

a bias/signal contact assembly which lies in a second of said passages, said bias/signal contact assembly including a conductive bias/signal body having forward and rearward end parts and a middle, said bias/signal body including a cylindrical portion having an outside diameter about the same as said board clip and electrically coupled to said first trace on said circuit board;

a second quantity of dielectric material surrounding a portion of said bias/signal middle which lies substantially within a corresponding one of said holes in said ground plane.

9. The connection apparatus described in claim 7, including:

a ground contact assembly which lies in a third of said passages, said ground contact assembly including a conductive ground body having forward and rearward end parts and a middle, said body including a largely cylindrical portion having an outside diameter about the same as that of said ground clip and electrically coupled to ground plane;

a third quantity of dielectric material surrounding a portion of said ground body middle which lies within a corresponding one of said holes in said circuit board.

10. A connector having a housing with an insulator assembly forming a plurality of elongated passages, and having a plurality of contact assemblies each mounted in one of said passages, including a first contact assembly that includes a conductive body having forward and rearward ends and a middle, that includes a circuit component mounted on said contact middle and having a plurality of terminals including a first terminal connected to said body middle and at least a second terminal, and that includes a clip connected to said second terminal, characterized by:

a circuit board mounted in said housing, said board lying in a plane that is normal to said passages and having a plurality of holes each aligned with one of said passages, said board having a first conductive trace coupled to said clip at one of said board holes.

11. The connector described in claim 10 includes:

a ground plane lying in said insulator assembly and extending primarily in a plane normal to the lengths of said passages, said ground plane having a plurality of holes each aligned with one of said passages;

said component has an additional terminal, and said first contact assembly includes an additional clip device connected to said additional terminal and to said ground plane.

12. The connector described in claim 10 wherein:

a second of said contact assemblies is a bias/signal contact assembly that lies in a second hole of said circuit board and that is coupled to said first conductive trace.

13. A method for constructing a connector which includes installing a plurality of insulators in a shell that has an axis, with each insulator having faces lying primarily in planes normal to said axis, including locating a sheet-like ground plane between a first pair of said insulators, wherein said ground plane and insulators have a plurality of holes forming a plurality of passages, characterized by:

constructing a plate-like circuit board and locating it between a second pair of said insulators, with said circuit board having a plurality of holes each aligned with one of said passages including a first hole aligned with a first of said passages, and with a first trace lying on said board and a board clip device connected to said trace and lying at said first circuit board hole;

forming a plurality of contact assemblies and installing each in a different one of said passages, including forming a component contact assembly with a conductive body having a middle, and mounting a circuit component on said body middle with said component having a first terminal connected to said body middle, and with said component having second and third terminals;

said step of forming a component contact assembly including installing first and second clips that each have fingers and a band, said fingers of said first and second clips respectively engaging said second and third terminals and said bands each extending around said body middle, and installing a potting material within said bands and around said body middle;

said step of installing includes inserting said component contact assembly into said first passage until said first and second clips respectively electrically couple to said ground plane to said circuit board trace.

14. The method described in claim 13 wherein:

said step of constructing said board includes plating said first hole by a plating that merges with said first trace, and installing a spring clip device in said plated hole and soldering it to said plating, wherein said clip device has a plurality of spring fingers extending beyond the faces of said board;

said step of installing said component contact includes sliding it into said first passage until said second clip wipes against said spring fingers of said spring clip device.

* * * * *